US008840045B2

(12) United States Patent
Thurin et al.

(10) Patent No.: US 8,840,045 B2
(45) Date of Patent: Sep. 23, 2014

(54) FLUID DISPENSING DEVICE HAVING MULTIPLE SPRAY PATTERNS

(75) Inventors: Matthew N. Thurin, Wauwatosa, WI (US); Darren K. Robling, Racine, WI (US); Linda Moy Madore, Vernon Hills, IL (US); Charles P. Althoff, Brooklyn, NY (US); Hideaki Matsui, New York, NY (US); Brook S. Kennedy, Glen Ridge, NJ (US); Stian Tesdal, New York, NY (US)

(73) Assignee: S.C. Johnson & Son, Inc., Racine, WI (US)

( * ) Notice: Subject to any disclaimer, the term of this patent is extended or adjusted under 35 U.S.C. 154(b) by 206 days.

(21) Appl. No.: 13/157,110

(22) Filed: Jun. 9, 2011

(65) Prior Publication Data

US 2012/0312896 A1 Dec. 13, 2012

(51) Int. Cl.

| | |
|---|---|
| ***A62C 31/02*** | (2006.01) |
| ***B05B 1/30*** | (2006.01) |
| ***B65D 83/00*** | (2006.01) |

(52) U.S. Cl.

USPC ..... 239/394; 239/397; 239/579; 222/402.13; 222/402.17

(58) Field of Classification Search

USPC ..... 239/337, 390–394, 397, 579; 222/402.1, 402.13, 153.1, 153.13, 222/153.14, 485, 144.5, 144, 402.17, 280, 222/167, 271, 295, 548

See application file for complete search history.

(56) References Cited

U.S. PATENT DOCUMENTS

| | | | | |
|---|---|---|---|---|
| 3,083,872 | A * | 4/1963 | Meshberg | 239/73 |
| 3,180,536 | A * | 4/1965 | Meshberg | 222/402.11 |
| 3,628,733 | A | 12/1971 | Kahn | |
| 3,703,994 | A | 11/1972 | Nigro | |
| 3,734,353 | A | 5/1973 | McIlhenny | |
| 3,767,125 | A | 10/1973 | Gehres et al. | |
| 3,795,366 | A | 3/1974 | McGhie et al. | |
| 4,257,560 | A | 3/1981 | Diamond | |
| 5,027,982 | A | 7/1991 | Demarest | |

(Continued)

FOREIGN PATENT DOCUMENTS

| | | |
|---|---|---|
| EP | 1726538 | 11/2006 |
| WO | WO 2004/078901 | 9/2004 |

(Continued)

OTHER PUBLICATIONS

PCT/US2012/041233 International Search Report dated Aug. 31, 2012.

*Primary Examiner* — Len Tran
*Assistant Examiner* — Alexander M Valvis

(57) ABSTRACT

A fluid dispensing device is disclosed that is capable of producing two distinct spray patterns. The device may include a rotatable hub having a first barrel for producing a first spray pattern and a second barrel for producing a second spray pattern. The barrels may be oriented in different directions with a predetermined angle between directions, such as approximately 180 degrees. A shell may be coupled to and rotatable with the hub. The shell may include a first portion having a first structural feature corresponding to a characteristic of the first spray pattern and a second portion may having a second structural feature corresponding to a characteristic of the second spray pattern. The structural features inform the user of a characteristic of the spray pattern that will be discharged by the device by the associated barrels, thereby permitting the user to intuitively select the desired spray pattern.

20 Claims, 9 Drawing Sheets

(56) References Cited

U.S. PATENT DOCUMENTS

| | | | | |
|---|---|---|---|---|
| 5,105,989 | A | 4/1992 | Gutkowski | |
| 5,363,992 | A * | 11/1994 | Meshberg | 222/309 |
| 5,385,303 | A | 1/1995 | Gosselin et al. | |
| 5,386,940 | A | 2/1995 | Berfield | |
| 5,649,645 | A | 7/1997 | Demarest et al. | |
| 5,752,631 | A | 5/1998 | Yabuno et al. | |
| 6,006,957 | A | 12/1999 | Kunesh | |
| 6,027,042 | A | 2/2000 | Smith | |
| 6,883,688 | B1 | 4/2005 | Stern et al. | |
| 6,905,050 | B1 | 6/2005 | Stern et al. | |
| 6,932,244 | B2 * | 8/2005 | Meshberg | 222/153.13 |
| 7,226,001 | B1 | 6/2007 | Stern et al. | |
| 7,402,554 | B2 | 7/2008 | Goldman et al. | |
| 7,651,992 | B2 | 1/2010 | Culeron et al. | |

FOREIGN PATENT DOCUMENTS

| | | |
|---|---|---|
| WO | WO 2004/078902 | 9/2004 |
| WO | WO 2004/078903 | 9/2004 |
| WO | 2012045562 A1 | 4/2012 |

* cited by examiner

FLUID DISPENSING DEVICE HAVING MULTIPLE SPRAY PATTERNS

FIELD OF THE DISCLOSURE

The present disclosure generally relates to fluid dispensing devices and, more particularly, to fluid dispensing devices capable of delivering multiple spray patterns.

BACKGROUND OF THE DISCLOSURE

Various types of fluid dispensing devices are known for dispensing controlled amounts of fluid in a spray pattern. Many of these devices include an aerosol container having a pressurized supply of fluid therein. A spray head may be connected to an outlet of a stem valve of the container, and may include a spray orifice configured to provide a desired spray pattern.

Some of the known fluid dispensing devices are capable of producing multiple different spray patterns. Certain of these multiple spray devices adjust the spray pattern by changing a spray nozzle located at the spray orifice. Other multi-spray devices use multiple barrels and/or sockets with dedicated spray nozzles to change spray patterns. Conventional multi-spray devices often use text or icons to identify spray settings, and therefore close scrutiny is required to determine the spray setting in which the device has been placed. Additionally, the text or icons do not clearly convey to the user the types of spray patterns that will be generated prior to actual use of the device. Still further, it is often difficult or cumbersome to manipulate conventional devices between spray settings.

SUMMARY OF THE DISCLOSURE

According to certain aspects of this disclosure, a fluid dispensing device may include a container defining an opening, a valve coupling having an inlet fluidly communicating with the container opening, an outlet, and an internal passage extending from the inlet to the outlet, and an actuator operably coupled to the valve coupling for actuating the valve coupling between open and closed positions. A hub may define a socket configured to rotatably receive the valve coupling and include a side wall extending over the valve coupling outlet. A first barrel may be coupled to the hub and define a first internal flow path fluidly communicating with the socket, the first barrel further including a first discharge orifice fluidly communicating with the first internal flow path and configured to discharge fluid in a first spray pattern. A second barrel may be coupled to the hub and define a second internal flow path fluidly communicating with the socket, the second barrel further including a second discharge orifice fluidly communicating with the second internal flow path and configured to discharge fluid in a second spray pattern. The second internal flow path may extend at an angle of 180 degrees relative to the first internal flow path. The hub is rotatable between a first position, in which the first internal flow path fluidly communicates with the valve coupling outlet, and a second position, in which the second internal flow path fluidly communicates with the valve coupling outlet.

According to additional aspects of this disclosure, a fluid dispensing device may include a container defining an opening, a valve coupling having an inlet fluidly communicating with the container opening, an outlet, and an internal passage extending from the inlet to the outlet, and an actuator operably coupled to the valve coupling for actuating the valve coupling between open and closed positions. A hub may define a socket configured to rotatably receive the valve coupling and include a side wall extending over the valve coupling outlet. A first barrel may be coupled to the hub and define a first internal flow path fluidly communicating with the socket, the first barrel further including a first discharge orifice fluidly communicating with the first internal flow path and configured to discharge fluid in a first spray pattern. A second barrel may be coupled to the hub and define a second internal flow path fluidly communicating with the socket, the second barrel further including a second discharge orifice fluidly communicating with the second internal flow path and configured to discharge fluid in a second spray pattern. The hub may rotate between a first position, in which the first internal flow path fluidly communicates with the valve coupling outlet, and a second position, in which the second internal flow path fluidly communicates with the valve coupling outlet. A shell is coupled to and rotatable with the hub. The shell includes a first portion defining a first aperture aligned with the first discharge orifice, and a second portion defining a second aperture aligned with the second discharge orifice. The shell first portion includes a first structural feature corresponding to a characteristic of the first spray pattern and the shell second portion including a second structural feature corresponding to a characteristic of the second spray pattern.

According to other aspects of this disclosure, a fluid dispensing device may include a container defining an opening, a valve coupling having an inlet fluidly communicating with the container opening, an outlet, and an internal passage extending from the inlet to the outlet, and an actuator operably coupled to the valve coupling for actuating the valve coupling between open and closed positions. A hub may define a socket configured to rotatably receive the valve coupling and include a side wall extending over the valve coupling outlet. A first barrel may be coupled to the hub and define a first internal flow path fluidly communicating with the socket, the first barrel further including a first discharge orifice fluidly communicating with the first internal flow path and configured to discharge fluid in a first spray pattern. A second barrel may be coupled to the hub and define a second internal flow path fluidly communicating with the socket, the second barrel further including a second discharge orifice fluidly communicating with the second internal flow path and configured to discharge fluid in a second spray pattern, wherein the second internal flow path extends at an angle of 180 degrees relative to the first internal flow path. The hub is rotatable between a first position, in which the first internal flow path fluidly communicates with the valve coupling outlet, and a second position, in which the second internal flow path fluidly communicates with the valve coupling outlet. A shell is coupled to and rotatable with the hub, the shell including a first portion defining a first aperture aligned with the first discharge orifice, and a second portion defining a second aperture aligned with the second discharge orifice. The shell first portion may include a first structural feature corresponding to a characteristic of the first spray pattern and the shell second portion may include a second structural feature corresponding to a characteristic of the second spray pattern.

BRIEF DESCRIPTION OF THE DRAWINGS

For a more complete understanding of this disclosure, reference should be made to the embodiments illustrated in greater detail on the accompanying drawings, wherein.

Figure 1:
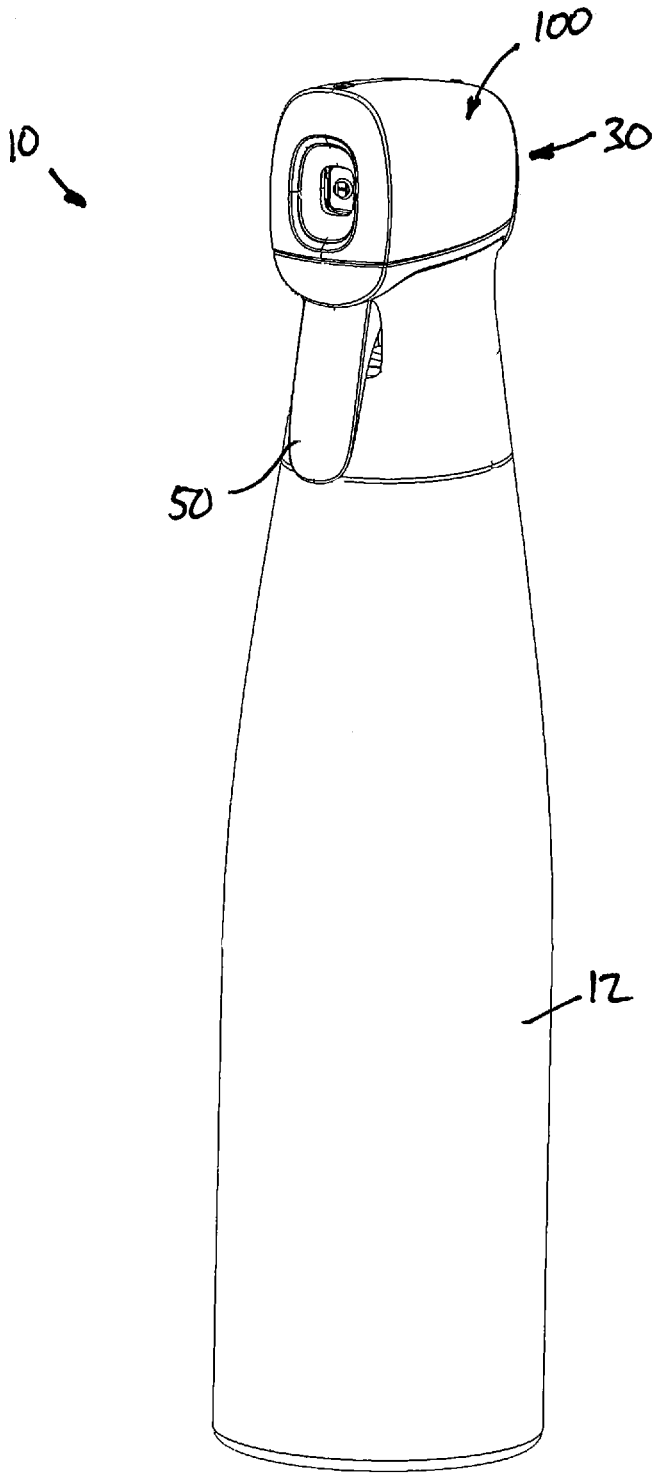
FIG. 1 is a perspective view of an exemplary fluid dispensing device constructed according to the teachings of the present disclosure.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION

Various embodiments of a fluid dispensing device are disclosed herein that are capable of producing at least two different spray patterns. The fluid dispensing device may include a rotatable hub having two separate barrels defining first and second flow paths. The hub may be rotated between a first position, in which the first flow path is aligned with an outlet of a valve coupling, and a second position, in which the second flow path is aligned with the valve coupling outlet, thereby to selectively choose a desired flow pattern. When the hub is between the two positions, neither flow path may be aligned with the coupling outlet, thereby preventing fluid flow from the device. The second barrel may be oriented at an angle of 180 degrees with respect to the first barrel, thereby requiring the hub to be rotated by a similar angle to change between the first and second flow paths. An outer shell may be coupled to the hub and configured for grasping by the user, thereby to facilitate rotation between the first and second positions.

Additionally or alternatively, the outer shell may be configured to communicate to a user the type of spray pattern that will be produced by the associated spray path. For example, a first portion of the shell may define a first aperture aligned with the first discharge orifice, and a second portion defining a second aperture aligned with the second discharge orifice. The shell first portion may include a first structural feature corresponding to a characteristic of the first spray pattern, and the shell second portion including a second structural feature corresponding to a characteristic of the second spray pattern. For example, the first spray pattern may be relatively larger while the second spray pattern is relatively smaller. The first structural feature may be an outer shell profile that generally diverges away from the first aperture, thereby evoking a wider spray coverage. The second structural feature may be an outer shell profile that generally converges toward the second aperture, thereby communicating to the user that the associated spray pattern is smaller or narrower. In this way, the spray settings may be more intuitively selected by the user.

As used herein, the term "spray jet" refers to the three-dimensional shape of the material between the exit orifice and the target surface, while the term "spray pattern" refers to the two-dimensional area of the target surface that is covered by material when the nozzle is held stationary.

Fluid dispensing devices may use a variety of different containers. The containers may hold one or a combination of various ingredients, and typically use a permanent or temporary pressure force to discharge the contents of the container. When the container is an aerosol can, for example, one or more chemicals or other active ingredients to be dispensed are usually mixed in a solvent and are typically further mixed with a propellant to pressurize the can. Known propellants include carbon dioxide, selected hydrocarbon gas, or mixtures of hydrocarbon gases such as a propane/butane mix. For convenience, materials to be dispensed may be referred to herein merely as "actives", regardless of their chemical nature or intended function. The active/propellant mixture may be stored under constant, but not necessarily continuous, pressure in an aerosol can. The sprayed active may exit in an emulsion state, single phase, multiple phase, and/or partial gas phase. Without limitation, actives can include insect control agents (such as propellant, insecticide, or growth regulator), fragrances, sanitizers, cleaners, waxes or other surface treatments, and/or deodorizers.

A first exemplary embodiment of a fluid dispensing device 10 is illustrated in FIGS. 1-8 in the environment of an aerosol container. It will be appreciated, however, that other types of containers and discharging means, such as manually compressible containers, manually operable pumps, or automatically operated pumps, may be used without departing from the scope of this disclosure.

Figure 3:
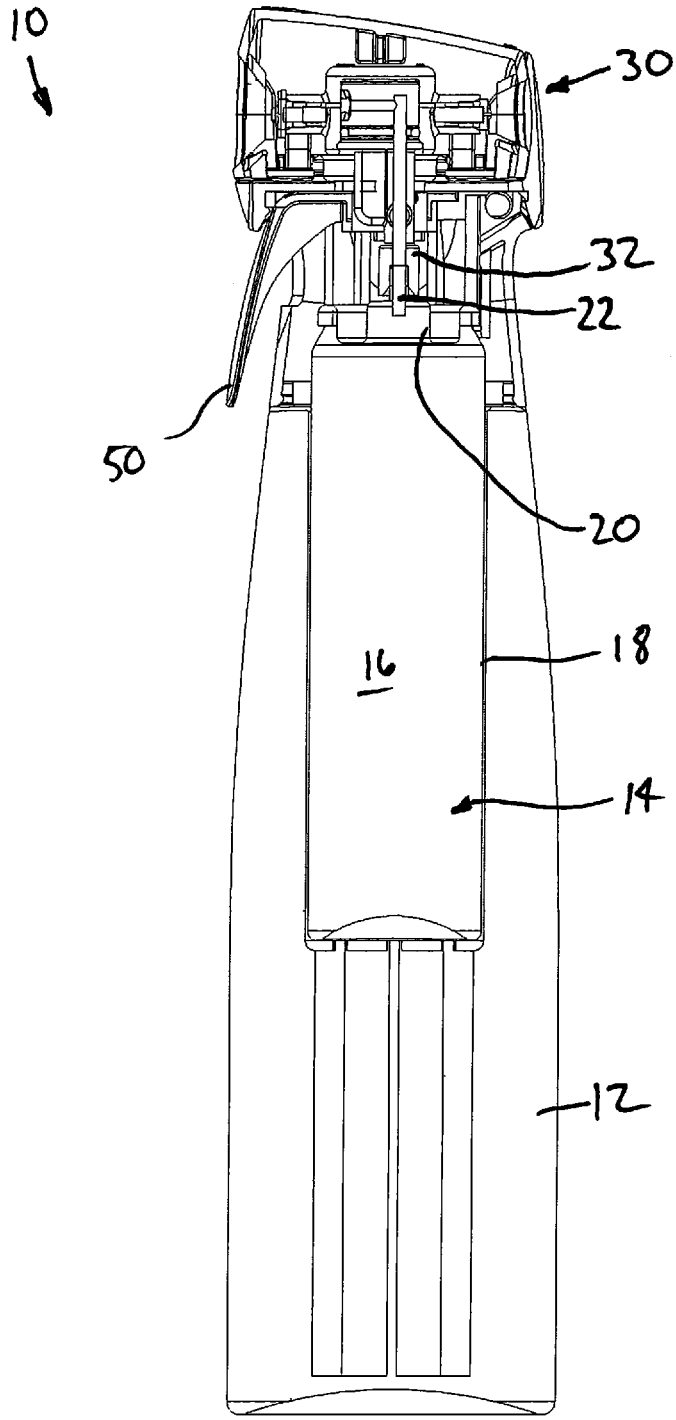
FIG. 3 is a side elevation view, in cross-section, of the fluid dispensing device of FIG. 1.

The illustrated fluid dispensing device 10 includes a container 12 housing an aerosol can 14. The aerosol can 14 may be formed of a conventional aerosol metal (e.g., aluminum or steel), that defines an internal chamber 16 capable of housing material to be dispensed under pressure. The can 14 includes a cylindrical wall 18 that is closed at its upper margin by a dome 20 (FIG. 3). The upper margin of the can wall 18 may be joined to the dome 20 via a can chime (not shown). The container 12 encloses the can 14 and may be formed of any suitable material, including plastic.

The fluid dispensing device 10 includes a conventional aerosol valve (see, e.g., U.S. Pat. No. 5,068,099 for another such valve). The aerosol valve has a valve stem 22 that is hollow and extends axially upward from the dome 20. In the exemplary embodiments described herein, the valve stem 22 is activated by deflecting the stem sideways, however other types of valves, such as a valve that actuates when the stem is depressed downward, or valves used in non-aerosol applications, may be used. Upon such activation, pressurized material from the container is released through the valve stem 22.

Figure 5:
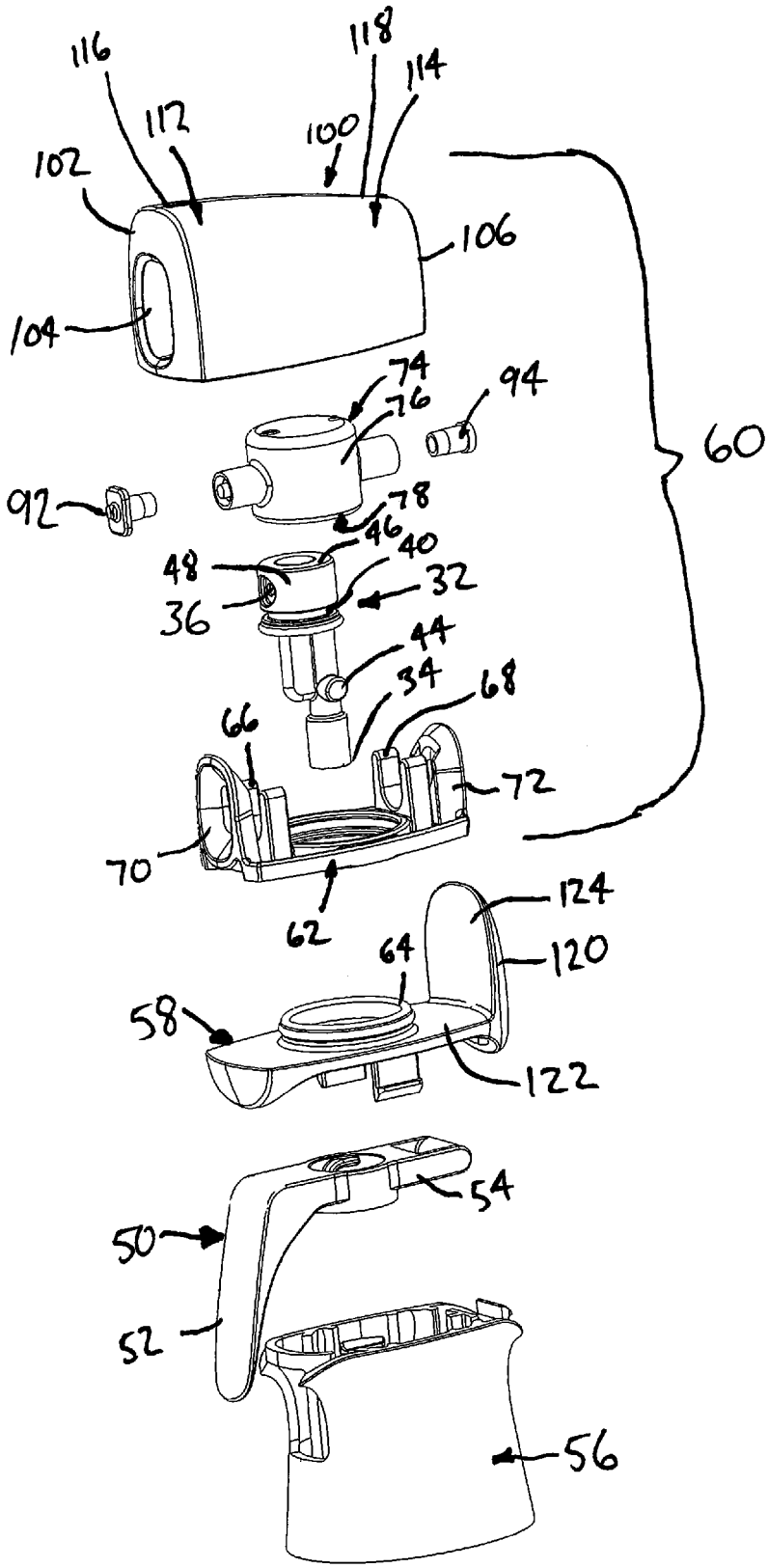
FIG. 5 is an exploded view of the top portion of the fluid dispensing device of FIG. 1.

An overcap assembly 30 is coupled to the container 12 for actuating the valve stem 22, as well as selecting a desired spray pattern, as discussed in greater detail below. The overcap assembly 30 may include a valve coupling 32 operatively coupled to the valve stem 22. In the illustrated embodiment, the valve coupling 32 includes an inlet 34 attached to and fluidly communicating with the valve stem 22, an outlet 36, and an internal passage 38 extending from the inlet 34 to the outlet 36. The valve coupling 32 may further include an annular groove 40 for receiving an o-ring 42, and a pair of actuating bosses 44. A top of the valve coupling 32 is formed as a head 46 having a cylindrical side wall 48. As best shown in FIG. 5, the outlet 36 extends through the side wall 48.

Figure 4:
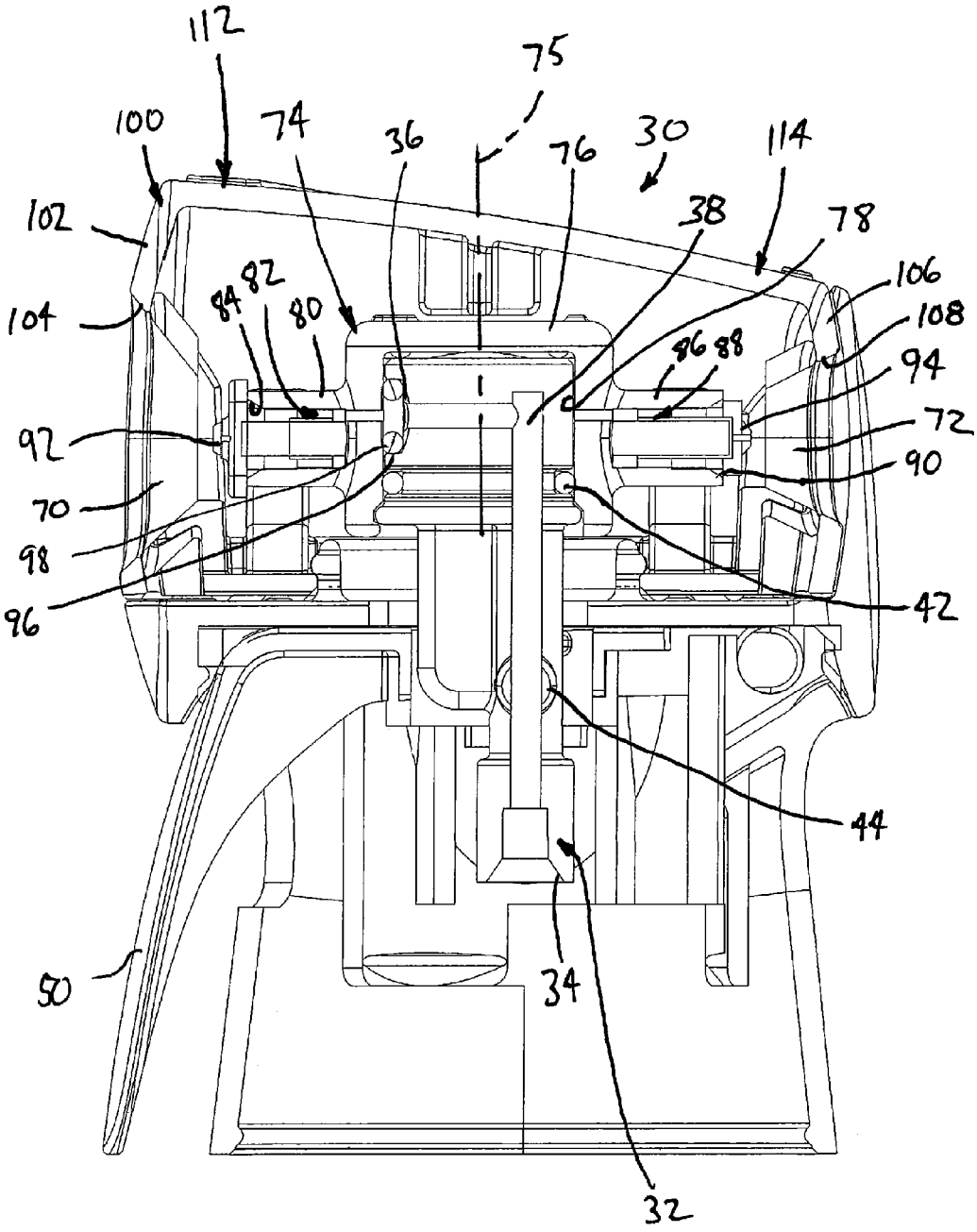
FIG. 4 is an enlarged side elevation view, in cross-section, of a top portion of the fluid dispensing device of FIG. 1.

An actuator lever 50 is operatively coupled to the valve coupling 32 to actuate the valve stem 22 between open and closed positions. As best shown in FIGS. 4 and 5, the actuator lever 50 includes grip portion 52 positioned to receive a user's finger(s) and an arm 54 engaging the actuating bosses 44 of the valve coupling 32. The actuator lever 50 is supported between a lower housing 56 coupled to the container 12 and an upper housing 58 attached to the lower housing 56. The actuator lever 50 may pivot relative to the lower housing 56 between a normal position, in which the valve stem 22 is in the vertical, closed position, and an actuated position, in which the arm 54 displaces the actuating bosses 44 to displace the valve stem 22 to a deflected position, thereby releasing actives.

A rotatable valve assembly 60 is coupled to the upper housing 58. In the illustrated embodiment, a carriage 62 is rotatably coupled to a sleeve 64 formed in the upper housing 58. The carriage 62 includes first and second brackets 66, 68 as well as first and second discharge horns 70, 72.

The rotatable valve assembly 60 further includes a manifold 74 defining multiple flow paths through which actives may be discharged. As best shown in FIGS. 4 and 5, the manifold 74 includes a central hub 76 defining a socket 78 sized to closely fit over the head 46 of the valve coupling 32. The socket 78 is configured to permit rotation of the manifold 74 relative to the valve coupling 32.

The manifold 74 further includes a first barrel 80 defining a first internal flow path 82 fluidly communicating between the socket 78 and a first discharge orifice 84. A second barrel 86 defines a second internal flow path 88 fluidly communicating between the socket 78 and a second discharge orifice 90. The manifold 74 may be positioned so that the first barrel 80 is received in the first bracket 66 of the carriage 62 and the second barrel 86 is received in the second bracket 68 of the carriage 62. When so positioned, the first discharge orifice 84 is aligned with the first discharge horn 70 and the second discharge orifice 90 is aligned with the second discharge horn 72.

The first discharge orifice 84 is configured to discharge actives in a first spray pattern, while the second discharge orifice 90 is configured to discharge actives in a second, different spray pattern. First and second nozzle inserts 92, 94 may be inserted into the first and second discharge orifices 84, 90 to obtain desired spray patterns. For example, FIG. 5 shows the first nozzle insert 92 configured to provide a relatively larger and/or wider spray pattern disposed in the first discharge orifice 84, while the second nozzle insert 94 may be configured to provide a relatively smaller and/or narrower spray pattern disposed in the second discharge orifice 90.

The manifold 74 is rotatable relative to the valve coupling 32 to place a selected one of the first and second internal flow paths 82, 88 in communication with the valve coupling outlet 36. The first and second barrels 80, 86 may be oriented so that the second internal flow path 88 extends at an angle relative to the first internal flow path 82. In the illustrated embodiment, the angle is approximately 180 degrees, so that the first internal flow path 82 is oriented in a direction substantially opposite that of the second internal flow path 88.

Figure 6:
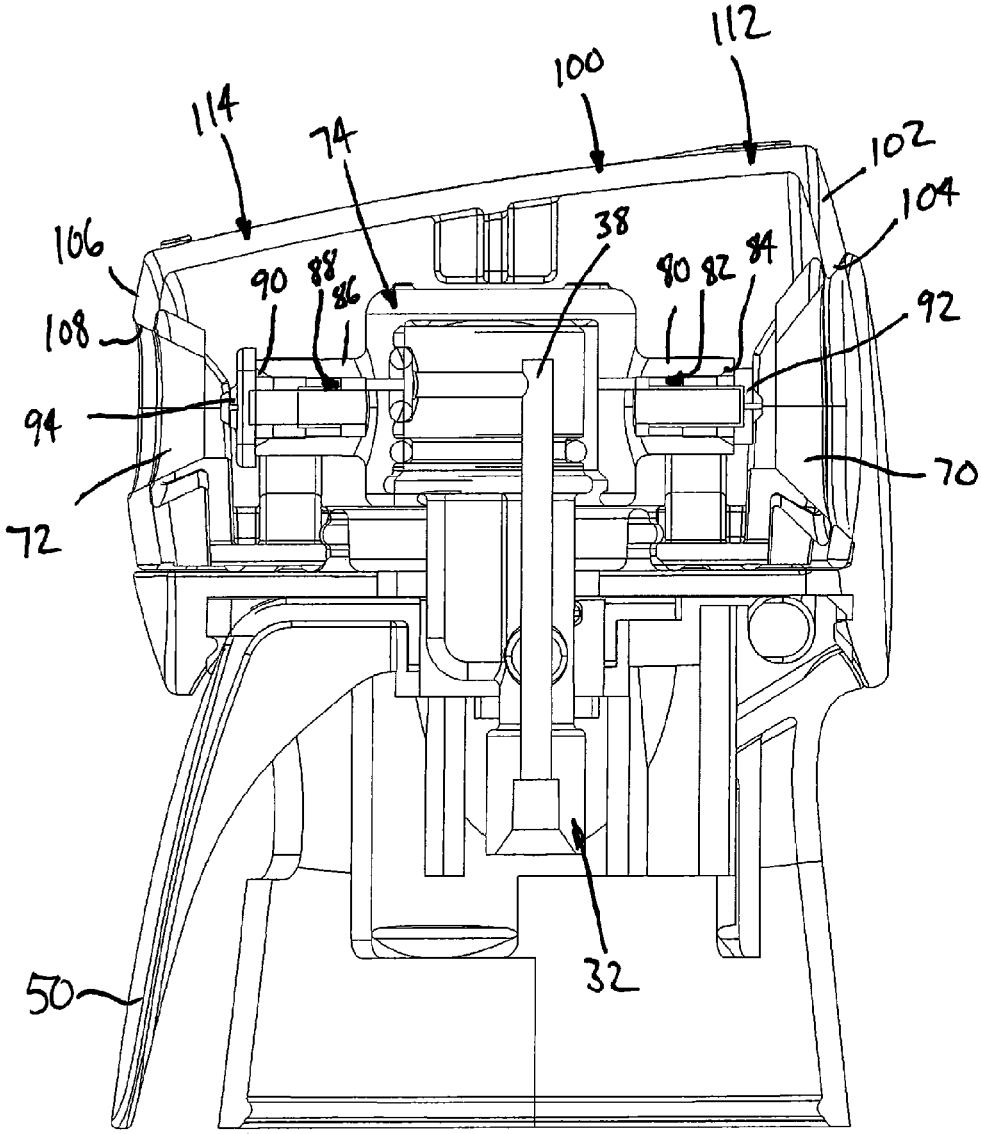
FIG. 6 is an enlarged side elevation view, in cross-section, of the top portion of the fluid dispensing device of FIG. 1 that is similar to FIG. 4, but with a valve assembly rotated 180 degrees.

The manifold 74 may have a first position, in which the first internal flow path 82 fluidly communicates with the valve coupling outlet 36 (as best shown in FIG. 4), and a second position, in which the second internal flow path 88 fluidly communicates with the valve coupling outlet 36 (as best shown in FIG. 6). In this exemplary embodiment, the manifold 74 is rotated 180 degrees to move between the first position and the second position. It will be appreciated, however, that the barrels 80, 86 may be provided at a different relative angle, with a consequent change in manifold rotation angle needed to move between first and second positions. Additionally, more than two barrels may be provided, thereby adding additional manifold positions and further altering the rotation angle of the manifold 74 between positions. Furthermore, when the manifold 74 is between the first and second positions, neither fluid flow path may communicate with the coupling outlet 36, thereby preventing discharge of any fluid from the device 10.

The manifold 74 rotates about a rotation axis 75. In the exemplary embodiment, the rotation axis 75 is substantially vertical and aligned with a longitudinal axis of the container 12. It will be appreciated, however, that the rotation axis 75 may have an orientation other than substantially vertical, and need not be aligned with the container longitudinal axis.

The socket 78 and valve coupling head 46 may be configured to permit fluid communication with only one internal fluid path at a time. As best shown in FIGS. 4 and 5, an annular channel 96 may be formed in the head 46 and surrounds the outlet 36. An outlet seal, such as o-ring 98, is positioned in the channel 96 to seal between the exterior surface of the head 46 and the socket 78. As a result, fluid from the internal passage 38 of the valve coupling 32 communicates only with the portion of the socket 78 that is aligned with the outlet 36. Accordingly, if the first internal flow path 82 is aligned with the outlet 32, the o-ring 98 prevents fluid communication from the outlet 32 to the second internal flow path 88, and vice versa. In this way, fluid is delivered only to the selected internal flow path.

An outer shell 100 may be provided to enclose the manifold 74 and carriage 62. In the illustrated embodiment, the outer shell 100 is attached to the carriage 62, and therefore is rotatable with the carriage 62 and manifold 74. The shell includes a first end 102 defining a first discharge aperture 104 that is aligned with the first discharge horn 70 and first discharge orifice 84, and a second end 106 defining a second discharge aperture 108 that is aligned with the second discharge horn 72 and the second discharge orifice 90. The outer shell 100 is configured for grasping by the user to actuate the manifold 74 between first and second positions. Accordingly, the outer shell 100 generally defines an oversized grip area sized and configured to facilitate grasping by a user.

The outer shell 100 may further be configured to communicate to a user, in an intuitive manner, one or more characteristics of the spray patterns that can be generated by the dispensing device 10. In the exemplary embodiment, the outer shell 100 includes a first portion 112 that includes the first end 102 and the first discharge aperture 104, and a second portion 114 that includes the second end 106 and the second discharge aperture 108. The first portion 112 includes a first structural feature corresponding to a characteristic of the first spray pattern, while the second portion 114 includes a second structural feature corresponding to a characteristic of the second spray pattern. For example, the first spray pattern may be larger than the second spray pattern, and therefore the first structural feature may be a first outer profile 116 that diverges away from the first discharge aperture 104, while the second structural feature may be a second outer profile 118 that converges toward the second discharge aperture 108. The diverging first outer profile 116 may convey to the user that the first spray pattern has a larger cross-sectional area, height, or width, while the converging second outer profile 118 may represent to the user that the second spray pattern has a smaller cross-sectional area, height, or width. The characteristic communicated by the structural features need not be related to the physical size of the spray pattern, but instead may related to the coverage density or other feature of the spray pattern, or the depth of surface coverage or other property resulting from the spray pattern. Additionally, while diverging and converging outer profiles are shown as examples, other types of structural features may be used.

Figure 2:
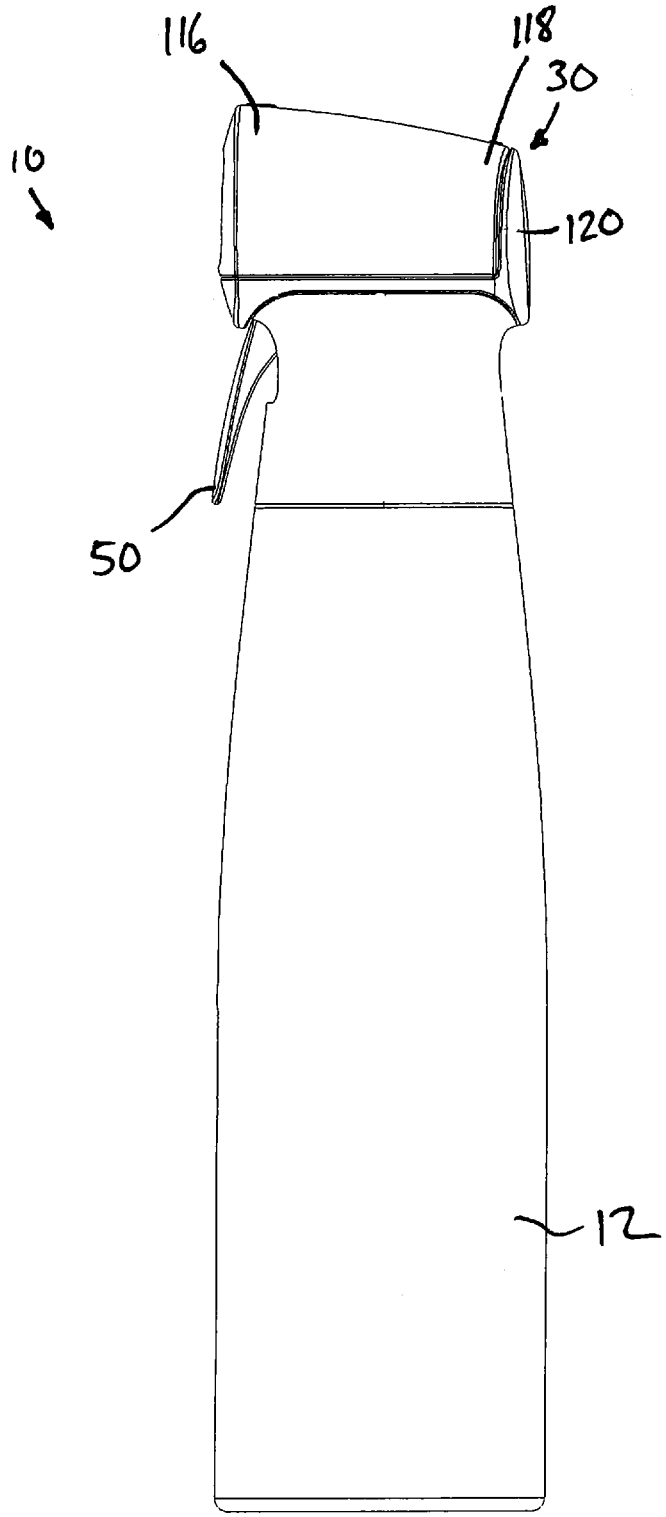
FIG. 2 is a side elevation view of the fluid dispensing device illustrated in FIG. 1.
Figure 7:
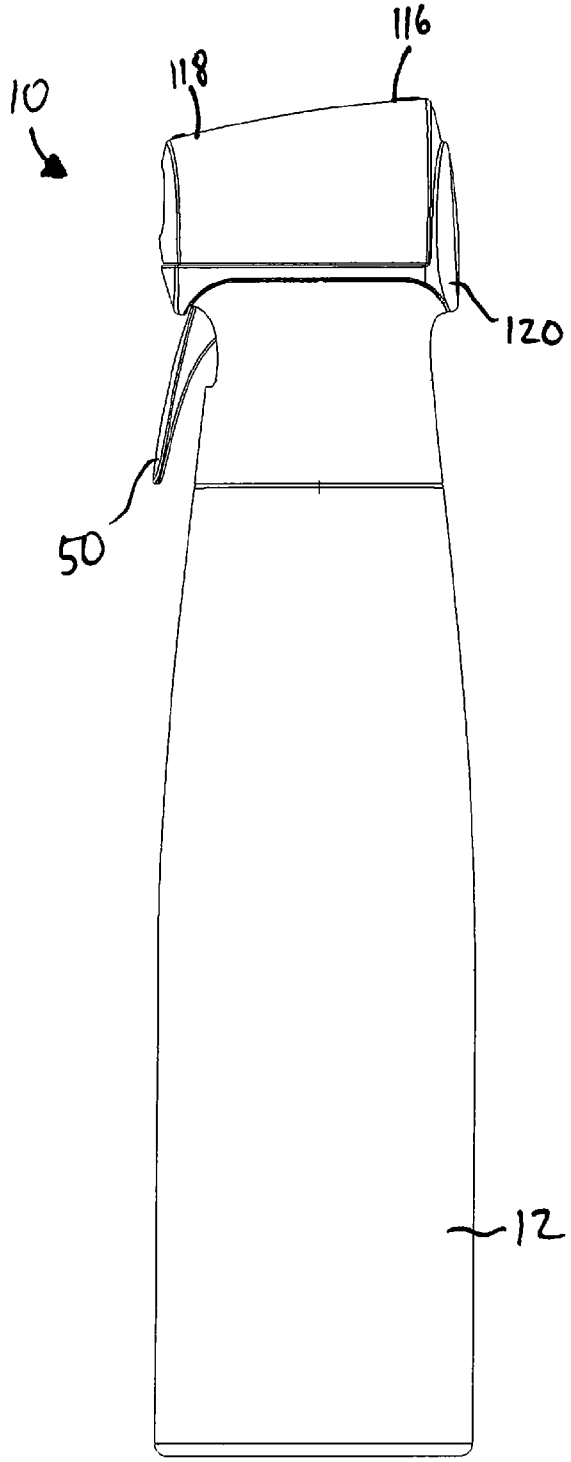
FIG. 7 is a side elevation view of the fluid dispensing device illustrated in FIG. 1 that is similar to FIG. 2, but with the valve assembly rotated 180 degrees.

The upper housing 58 may include a cap end 120 to provide a clear indication of which direction the fluid dispensing device 10 will spray and to prevent inadvertent discharge of fluid in an unintended direction. As best shown in FIGS. 4 and 5, the cap end 120 extends upwardly from a base 122 of the upper housing 58. The cap end 120 includes a curved interior surface 124 which permits rotation of the outer shell 100 as the manifold 74 moves between first and second positions. The cap end 120 may be configured to extend over the first discharge aperture 104 of the outer shell 100 when the manifold 74 is in the first position (as best shown in FIGS. 2-4), and to extend over the second discharge aperture 108 of the outer shell 100 when the manifold 74 is in the second position (as best shown in FIGS. 6-7). Covering one of the discharge apertures 104, 108 with the cap end 120 provides the user an indication as to which end from which the spray will discharge when the actuator lever 50 is actuated. The cap end will also prevent unintended discharge from the non-selected aperture should one of the o-rings 42, 98 fail.

Figure 9:
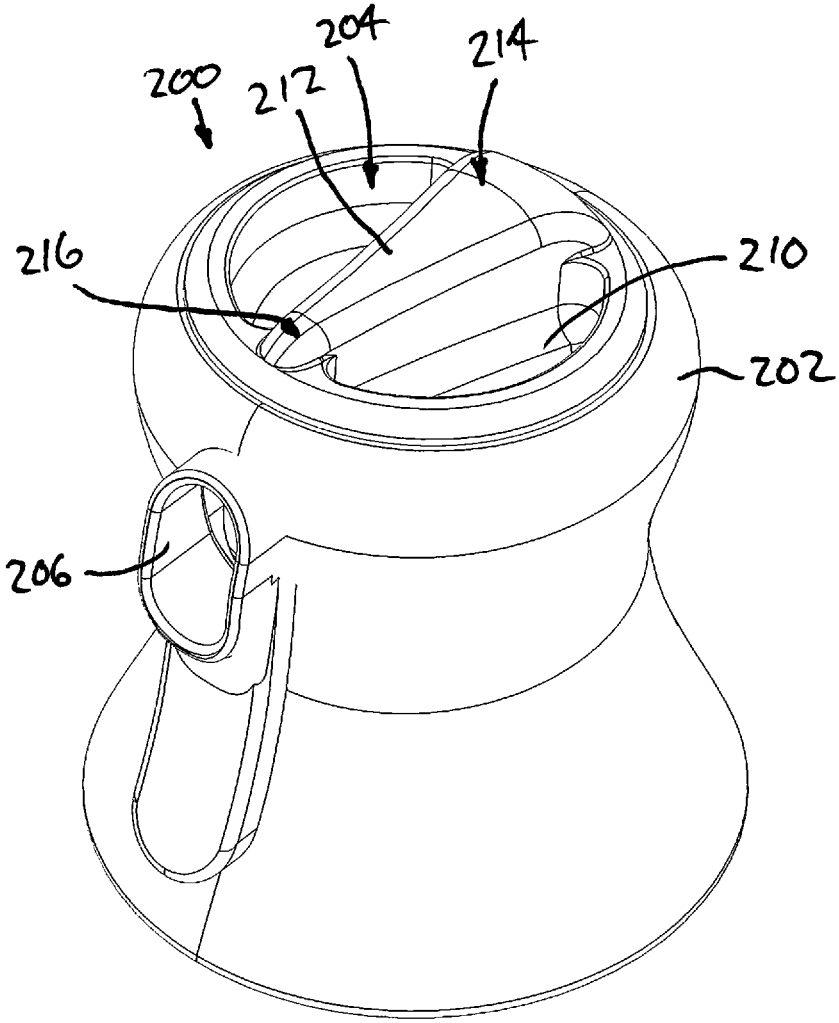
FIG. 9 is a perspective view of an alternative embodiment of a fluid dispensing device according to the present disclosure.

An alternative embodiment of a fluid dispensing device 200 is illustrated in FIG. 9. The fluid dispensing device 200 substantially identical to the fluid dispensing device 100, except for a stationary outer shell 202 and a rotatable selector 204. Accordingly, the fluid dispensing device 200 includes a stationary valve coupling and a rotatable valve assembly (including a manifold having first and second barrels), which are disposed inside the outer shell 202 and therefore not shown in FIG. 9. The outer shell 202 includes a single discharge aperture 206. The selector 204 is coupled to and rotates with the manifold, so that rotation of the selector 204 will rotate a selected one of the first and second barrels into alignment with the discharge aperture 206.

The fluid dispensing device 200 includes structural features for indicating the type of spray pattern to be discharged by the device. In the illustrated embodiment, the selector 204 includes a base 210 and an upwardly projecting ridge 212. The ridge 212 includes a first end 214 and a second end 216. The sidewalls of the ridge first end 214 diverge from one another to indicate that the spray pattern will be relatively large when the first end 214 is rotated to be nearer the discharge aperture 206. Conversely, the sidewalls of the ridge second end 216 converge from one another to indicate that the spray pattern will be relatively small when the second end 216 is rotated to be nearer the discharge aperture 206.

While such embodiments have been set forth, alternatives and modifications will be apparent in the above description to those skilled in the art. These and other alternatives are considered equivalents in the spirit and scope of this disclosure and the appended claims.

INDUSTRIAL APPLICABILITY

The various embodiments of a fluid dispensing device disclosed herein may be capable of discharging an active in multiple spray patterns. The device may be used to dispense fragrances, cleaners, pest repellants, or other types of actives.

Figure 8A:
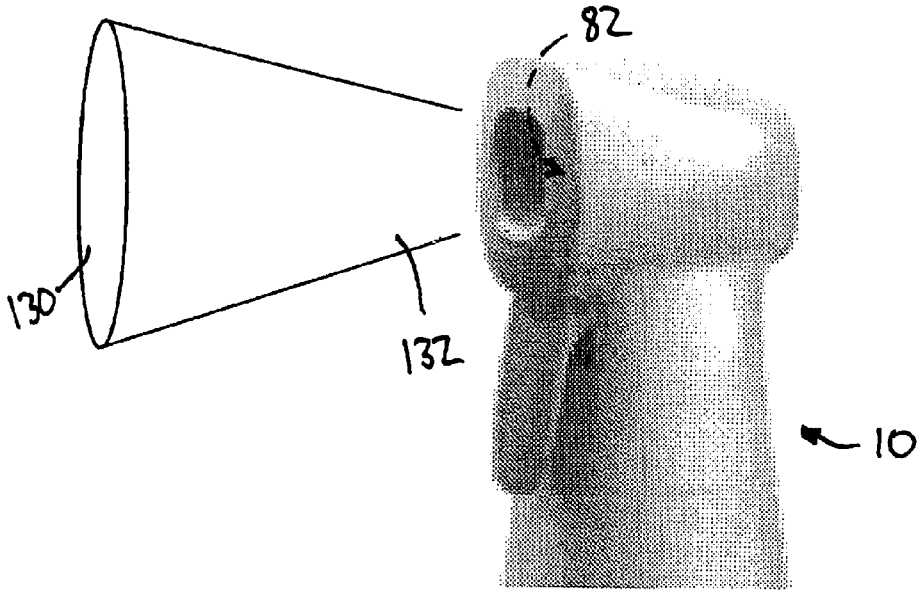
FIG. 8A is a schematic perspective view of the fluid dispensing device generating a first spray pattern.
Figure 8B:
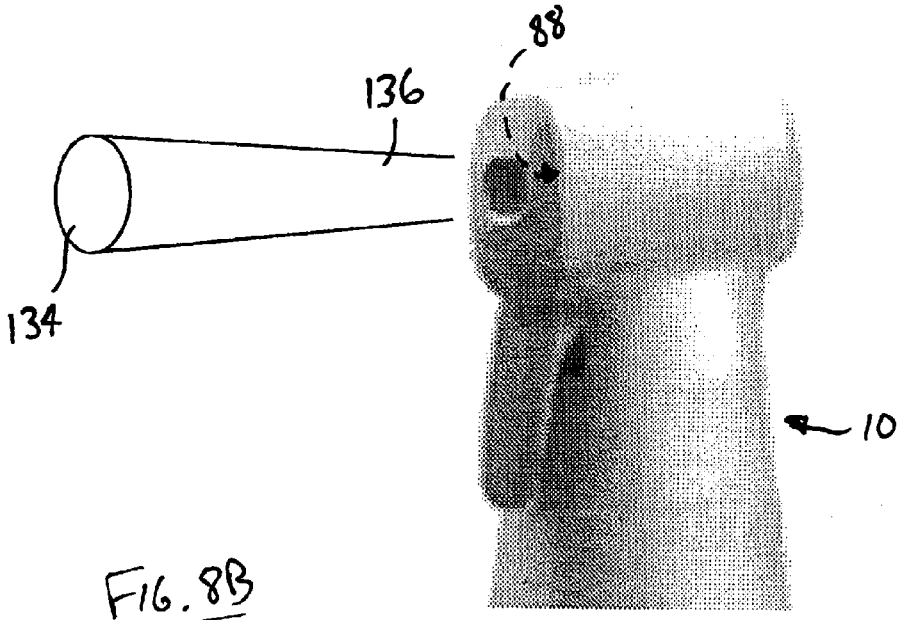
FIG. 8B is a schematic perspective view of the fluid dispensing device generating a second spray pattern.

More specifically, the fluid dispensing device 10 has a valve assembly 60 that is rotatable relative to the container 12 to select a desired spray pattern. In one embodiment, the valve assembly may be rotated 180 degrees between first and second internal flow paths 82, 88 thereby to selectively provide first and second spray patterns. The internal flow paths 82, 88 may be configured, such as with inserts 92, 94, to produce different spray patterns. For example, the first internal flow path 82 may generate a relatively large spray pattern 130 as shown in FIG. 8A. A spray jet 132 exiting the discharge orifice may be asymmetrical so that the resulting spray pattern 130 is oval shaped, with a vertical major axis and a horizontal minor axis. Accordingly, the spray pattern 130 may cover a relatively large area of the target surface. Additionally, the second internal flow path 88 may generate a relatively small spray pattern 134 as shown in FIG. 8B. A spray jet 136 exiting the discharge orifice may be substantially cone shaped so that the resulting spray pattern 134 has a circular shape. The spray pattern 134 may cover a relatively small area of the target surface.

The spray patterns produced by the first and second internal flow paths 82, 88 may have other differentiating characteristics. If, for example, the fluid comprises a household cleaner such as a bathroom cleaner, the first spray pattern may generate a relatively thicker layer of foam on the target surface, while the second spray pattern may generate less foam upon contact with the target surface. A larger, higher foam content spray pattern may be advantageous for cleaning showers and baths, while a smaller, lower foam content spray pattern may be advantageous for cleaning sinks. The fluid dispensing device 10 may be quickly and easily switched between the spray patterns by rotating the valve assembly 60.

What is claimed is:

1. A fluid dispensing device comprising:

a container defining an opening;

a valve coupling having an inlet fluidly communicating with the container opening, an outlet, and an internal passage extending from the inlet to the outlet;

an actuator operably coupled to the valve coupling for actuating the valve coupling between open and closed positions;

a hub defining a socket configured to rotatably receive the valve coupling, the hub including a side wall extending over the valve coupling outlet;

a first barrel coupled to the hub and defining a first internal flow path fluidly communicating with the socket, the first barrel further including a first discharge orifice fluidly communicating with the first internal flow path and configured to discharge fluid in a first spray pattern;

a second barrel coupled to the hub and defining a second internal flow path fluidly communicating with the socket, the second barrel further including a second discharge orifice fluidly communicating with the second internal flow path and configured to discharge fluid in a second spray pattern;

wherein the hub is rotatable relative to the valve coupling between a first position, in which the first internal flow path fluidly communicates with the valve coupling outlet, and a second position, in which the second internal flow path fluidly communicates with the valve coupling outlet;

a shell coupled to and rotatable with the hub, the shell including a first portion defining a first aperture aligned with the first discharge orifice, and a second portion defining a second aperture aligned with the second discharge orifice and;

a carriage coupled to the hub and the shell and configured to enable coupled rotation of the hub and the shell between the first position and the second position.

2. The fluid dispensing device of claim 1, in which the shell first portion includes a first structural feature corresponding to a characteristic of the first spray pattern.

3. The fluid dispensing device of claim 2, in which the first spray pattern is larger than the second spray pattern, and the first structural feature comprises an outer profile of the shell first portion which diverges away from the first aperture.

4. The fluid dispensing device of claim 3, in which the shell second portion includes a second structural feature corresponding to a characteristic of the second spray pattern.

5. The fluid dispensing device of claim 4, in which the second structural feature comprises an outer profile of the shell second portion which converges toward the second aperture.

6. The fluid dispensing device of claim 1, wherein the carriage is coupled to the shell and enables coupled rotation of the shell and the hub between the first position and the second position.

7. The fluid dispensing device of claim 1, wherein the carriage has a collar rotatably coupled to the container and first and second brackets respectively engaging the first and second barrels.

8. The fluid dispensing device of claim 1, wherein the carriage comprises a first discharge horn and a second discharge horn respectively aligning with the first discharge orifice and the second discharge orifice.

9. The fluid dispensing device of claim 1, further comprising a nozzle insert coupled to the first discharge orifice.

10. The fluid dispensing device of claim 1, in which the second internal flow path extends at an angle of 180 degrees relative to the first internal flow path.

11. A fluid dispensing device comprising:

a container defining an opening;

a valve coupling having an inlet fluidly communicating with the container opening, an outlet, and an internal passage extending from the inlet to the outlet;

an actuator operably coupled to the valve coupling for actuating the valve coupling between open and closed positions;

a hub defining a socket configured to rotatably receive the valve coupling, the hub including a side wall extending over the valve coupling outlet;

a first barrel coupled to the hub and defining a first internal flow path fluidly communicating with the socket, the first barrel further including a first discharge orifice fluidly communicating with the first internal flow path and configured to discharge fluid in a first spray pattern;

a second barrel coupled to the hub and defining a second internal flow path fluidly communicating with the socket, the second barrel further including a second discharge orifice fluidly communicating with the second internal flow path and configured to discharge fluid in a second spray pattern;

wherein the hub is rotatable relative to the valve coupling between a first position, in which the first internal flow path fluidly communicates with the valve coupling outlet, and a second position, in which the second internal flow path fluidly communicates with the valve coupling outlet; and a shell coupled to and rotatable with the hub, the shell including a first portion defining a first aperture aligned with the first discharge orifice, and a second portion defining a second aperture aligned with the second discharge orifice, the shell first portion including a first structural feature corresponding to a characteristic of the first spray pattern and the shell second portion including a second structural feature corresponding to a characteristic of the second spray pattern; and a carriage attached to the hub and the shell and configured to enable coupled rotation of the hub and the shell between the first position and the second position.

12. The fluid dispensing device of claim 11, in which the first spray pattern is larger than the second spray pattern, and the first structural feature comprises an outer profile of the shell first portion which diverges away from the first aperture.

13. The fluid dispensing device of claim 12, in which the second structural feature comprises an outer profile of the shell second portion which converges toward the second aperture.

14. The fluid dispensing device of claim 11, in which the second internal flow path extends at an angle of 180 degrees relative to the first internal flow path.

15. The fluid dispensing device of claim 11, further comprising a carriage having a collar rotatably coupled to the container and first and second brackets respectively engaging the first and second barrels, in which the shell is fixed to the carriage.

16. The fluid dispensing device of claim 11, in which the container defines a substantially vertical axis, and in which the hub rotates about the vertical axis.

17. The fluid dispensing device of claim 11, in which the hub, first barrel, and second barrel are integrally formed as a manifold.

18. The fluid dispensing device of claim 11, further comprising a nozzle insert coupled to the first discharge orifice.

19. A fluid dispensing device comprising:

a container defining an opening;

a valve stem fluidly communicating with the opening;

a valve coupling operatively coupled to the valve stem and having an inlet fluidly communicating with the valve stem, an outlet, and an internal passage extending from the inlet to the outlet;

an actuator operably coupled to the valve coupling for actuating the valve coupling between open and closed positions;

a hub defining a socket configured to rotatably receive the valve coupling, the hub including a side wall extending over the valve coupling outlet;

a first barrel coupled to the hub and defining a first internal flow path fluidly communicating with the socket, the first barrel further including a first discharge orifice fluidly communicating with the first internal flow path and configured to discharge fluid in a first spray pattern;

a second barrel coupled to the hub and defining a second internal flow path fluidly communicating with the socket, the second barrel further including a second discharge orifice fluidly communicating with the second internal flow path and configured to discharge fluid in a second spray pattern, wherein the second internal flow path extends at an angle of 180 degrees relative to the first internal flow path;

wherein the hub is rotatable relative to the valve coupling between a first position, in which the first internal flow path fluidly communicates with the valve coupling outlet, and a second position, in which the second internal flow path fluidly communicates with the valve coupling outlet;

a shell coupled to and rotatable with the hub, the shell including a first portion defining a first aperture aligned with the first discharge orifice, and a second portion defining a second aperture aligned with the second discharge orifice, the shell first portion including a first structural feature corresponding to a characteristic of the first spray pattern and the shell second portion including a second structural feature corresponding to a characteristic of the second spray pattern; and a carriage attached to the hub and the shell and configured to enable coupled rotation of the hub and the shell between the first position and the second position.

20. The fluid dispensing device of claim 19, in which the first spray pattern is larger than the second spray pattern, the first structural feature comprises an outer profile of the shell first portion which diverges away from the first aperture, and the second structural feature comprises an outer profile of the shell second portion which converges toward the second aperture.

* * * * *